US008286736B2

(12) United States Patent
Weaver et al.

(10) Patent No.: US 8,286,736 B2
(45) Date of Patent: Oct. 16, 2012

(54) DRILL BIT, A DRILL ROD AND A SELF DRILLING ROOF BOLT

(75) Inventors: Steven Weaver, Maryland (AU); Michael McLean, Hamilton East (AU)

(73) Assignee: Sandvik Intellectual Property AB, Sandviken (SE)

( * ) Notice: Subject to any disclaimer, the term of this patent is extended or adjusted under 35 U.S.C. 154(b) by 1389 days.

(21) Appl. No.: 10/545,181

(22) PCT Filed: Feb. 6, 2004

(86) PCT No.: PCT/SE2004/000153

§ 371 (c)(1),
(2), (4) Date: Jun. 6, 2006

(87) PCT Pub. No.: WO2004/074635

PCT Pub. Date: Sep. 2, 2004

(65) Prior Publication Data

US 2007/0000701 A1 Jan. 4, 2007

(30) Foreign Application Priority Data

Feb. 19, 2003 (AU) ..... 2003200561

(51) Int. Cl.
*E21B 10/36* (2006.01)

(52) U.S. Cl. ..... 175/420.1; 175/415; 175/427; 175/417

(58) Field of Classification Search ..... 175/420.1, 175/415, 427, 417; 405/259.1
See application file for complete search history.

(56) References Cited

U.S. PATENT DOCUMENTS

| | | | | | |
|---|---|---|---|---|---|
| 3,850,054 | A * | 11/1974 | Weissman | 76/108.1 |
| 4,527,931 | A * | 7/1985 | Sarin | 407/113 |
| 4,712,626 | A * | 12/1987 | Shaw | 175/420.1 |
| 4,819,748 | A * | 4/1989 | Truscott | 175/420.1 |
| 5,400,861 | A * | 3/1995 | Sheirer | 175/427 |
| 5,704,438 | A * | 1/1998 | Kloppers et al. | 175/420.1 |
| 5,833,017 | A * | 11/1998 | Woods et al. | 175/320 |
| 5,836,410 | A * | 11/1998 | Kleine | 175/415 |
| 5,927,912 | A * | 7/1999 | Mihai et al. | 408/226 |
| 5,951,208 | A * | 9/1999 | Wilson et al. | 405/259.6 |
| 5,996,714 | A * | 12/1999 | Massa et al. | 175/413 |
| 6,260,638 | B1 | 7/2001 | Massa et al. | |
| 6,309,159 | B1 * | 10/2001 | Weaver et al. | 411/387.5 |
| 2001/0030067 | A1 * | 10/2001 | Evans et al. | 175/374 |
| 2002/0020566 | A1 * | 2/2002 | Hauptmann et al. | 175/415 |
| 2002/0053473 | A1 * | 5/2002 | Knoller | 175/417 |
| 2003/0000745 | A1 * | 1/2003 | Huber | 175/427 |
| 2003/0068209 | A1 * | 4/2003 | Leibhard et al. | 408/231 |
| 2003/0116359 | A1 * | 6/2003 | Richter et al. | 175/417 |
| 2004/0089481 | A1 * | 5/2004 | Bise et al. | 175/427 |

FOREIGN PATENT DOCUMENTS

| | | |
|---|---|---|
| DE | 101 14 882 | 10/2002 |
| DE | 10114882 | * 10/2002 |
| GB | 664 983 | 1/1952 |

* cited by examiner

*Primary Examiner* — Cathleen Hutchins
(74) *Attorney, Agent, or Firm* — Morgan, Lewis & Bockius LLP

(57) ABSTRACT

A drill bit for attachment to an elongate drill rod, the drill bit including means for attachment to an end of the drill rod, and a leading end which defines a pair of diametrically opposed slots which open axially for receipt of a portion of a drill tip which projects axially from the slots. The drill tip being fixedly secured within each of the slots. Further, a drill rod or a self drilling roof bolt comprising the drill bit.

15 Claims, 1 Drawing Sheet

DRILL BIT, A DRILL ROD AND A SELF DRILLING ROOF BOLT

BACKGROUND

The present invention relates to a drill bit, in particular for the drilling of rock. The invention has particular relevance to drill rods and to bolts of the type known as rock or roof bolts (hereinafter called "roof bolts") and to such bolts of the self drilling kind.

Roof bolts are commonly employed in the underground mining industry to support the walls and/or the roof of excavated tunnels and openings against fragmentation and collapse. Roof bolts typically are applied by first drilling a pilot hole in the rock wall and thereafter inserting the roof bolt therein. The bolt is fixed within the hole normally by a settable glue, such as a resin or a mortar cement. Otherwise, the roof bolt can be arranged to interlock with the internal wall of the pilot opening, such as by a thread or an expanding sleeve and typically a combination of settable glue and an interlocking arrangement is employed.

Self drilling roof bolts have a drilling capacity that a simple roof bolt does not have. If a self drilling roof bolt is employed, the bolt itself can be driven to drill into the rock wall and when the bolt has sufficiently penetrated the wall, suitable fixing means, such as a settable resin may be employed. A self drilling roof bolt therefore increases the speed at which roof bolts can be installed, because it eliminates the need to remove the drill from the pilot hole to insert the roof bolt. Effectively the drilling operation and the insertion are completed at the same time. This advantageously means that the drill operator is next to the unsupported wall, or is under the unsupported roof, for a significantly reduced amount of time, thereby reducing the risk of injury to such operators.

U.S. Pat. No. 6,309,159 discloses a self drilling roof bolt which has an elongate bolt body and a drill tip attached to the leading end thereof. The drill tip extends across the end of the bolt and is supported against a pair of radially spaced, axially extending abutment elements, which engage the drill tip on opposite sides thereof. In practice the tip is secured to the abutment elements by welding, soldering or brazing.

In the self drilling roof bolt of U.S. Pat. No. 6,309,159 the type of mechanism used to secure the tip to the abutment elements adds significant cost to the roof bolt.

As the welding, soldering or brazing operation must be carefully performed so as to ensure the integrity of the connection under the highly aggressive conditions of drilling.

A further disadvantage resides in the most common form of connection which is brazing, because brazing requires expensive induction equipment for production line manufacture. Also, a brazed connection often suffers from concentricity problems between the tip and the bolt body or shank, because during brazing, it is difficult to maintain proper concentric alignment.

It is an object of the invention to provide a drill bit for a drill rod and/or a self drilling roof bolt which provides an alternative connection arrangement between the drill tip and the leading end of the rod or bolt to improve the connection therebetween and/or to facilitate connection by different means to those discussed above.

SUMMARY OF INVENTION

According to the present invention there is provided a drill bit for attachment to an elongate drill rod, said drill bit including means for attachment to an end of said drill rod, a leading end which defines a pair of diametrically opposed slots, which open axially for receipt of a portion of a drill tip which projects axially from said slots, said drill tip being fixedly secured within each of said slots.

The present invention further provides a drill rod to which a drill bit as described above, is attached.

The present invention still further provides a drill rod which is formed as a self drilling roof bolt to which a drill bit as described above, is attached. In the alternative, the invention provides a self drilling roof bolt in which the drill bit is integrally formed with the bolt at one end thereof.

The present invention advantageously provides for extremely secure location of the drill tip in the drill bit. The drill tip may be a single piece or "spade" tip, which extends radially across the leading end of the drill bit, or it may be formed by a pair of tips or "wing tip", each of which is received within one of the pair of slots. In the latter arrangement, the pair of tips are separate and when fixed in the respective slots, the tips are separated by a central or axial gap. If the drill tip is a single piece, it is secured on opposite sides thereof and at each of the opposite ends thereof. Each of these arrangement facilitates the preferred use of adhesive glue to fix the drill tip (whether a single or two-piece tip) in place, rather than the prior art arrangements which utilize welding, soldering or brazing, although the invention includes within its scope fixing by such means. The preferred use of glue is facilitated by the increased surface area provided for bonding between the drill tip and the slot surfaces. That increased surface area means an adequate adhesive bond can be formed between the slots and the drill tip, which is not possible, or which is not reliable, when the drill tip is securable only against a single surface, or abutment face as in the prior art. In such prior art arrangements, the use of adhesive glue is not appropriate.

The benefit of securing the drill tip in place by adhesive glue, is that the glue is far more easily handled and applied and does not require induction equipment of the kind which is presently employed in some non-glue applications. Also, the provision of slots is such as to more securely hold the drill tip in place when it is being fitted to the drill bit.

The drill bit preferably includes a pair of axially extending abutment elements which define the slots that receive the drill tip (hereinafter the expression "drill tip" will include both single piece and two-piece tips). The abutment elements can be formed in any suitable manner, such as by machining, or investment casting, or other suitable process. Preferably the abutment elements have leading and trailing ends and each slot is formed toward the leading end rather than the trailing end. This facilitates minimizing the bulk or mass of the abutment elements, because the majority of load the drill tip experiences during drilling is transmitted to the trailing end of the abutment elements, whereas the leading ends experience relatively little load. Accordingly, the leading end can be of a relatively reduced thickness compared to the trailing end.

The slot formed in each abutment element preferably is generally rectangular in cross-section and is of a depth sufficient to accept almost the full height of the drill tip, although the depth of the slots may vary radially with variation in the height of the drill tip. If necessary, one of the leading or trailing ends can have a reduced height compared to the other of those ends. In particular, the leading end may be of reduced height given that it has relatively low exposure to load during drilling compared to the trailing end. The cross-sectional width of each slot preferably is about equal to, although slightly greater than the cross-sectional width of the drill tip, so that the drill tip is snugly received within each slot. The radial length of each slot can be equal to the wall thickness of the drill bit about the through bore, so that the slots can be formed through the full wall thickness, and do not need to be formed lesser or greater than that thickness. The base of each slot typically will be flat and will extend generally perpendicular to the lengthwise axis of the rod or bolt to which the drill bit is attached, while the upper ends of each slot can be angled, or inclined at the same, or a similar angle to the cutting edge of the drill tip. Such drill tips often will be inclined on opposite sides thereof towards a center apex and for proper support, the upper slot edges can have the same or similar inclined configuration.

The drill bit preferably includes a central bore which in use, preferably is aligned coaxially with the bore formed in the drill rod. The arrangement preferably is such that the central bore of the drill bit is open at the leading end, so that flushing medium which is used to flush drilled debris out of the hole being drilled and, in the case of self drilling roof bolts, glue which is used to secure the bolt in place in the rock, can be pumped through the central bore of both the drill rod or bolt and the drill bit, and egress out thereof through the leading end. The abutment elements must be arranged so as to permit the egress of the flushing medium and the glue from the central bore. This can be achieved by placement of the abutment elements on diametrically opposite sides of the central bore, so that the bore is open on either side of the drill tip which extends across the open end of the bore.

In a preferred arrangement, the drill tip extends diametrically on either side thereof beyond the external periphery of the bolt at the leading end. In other words, the radial extent of the drill tip is greater that the diameter of the bolt at the leading end.

If glue is employed to secure the drill tip to the leading end any suitable glue may be employed. For example, an epoxy resin may be employed. Advantageously, the use of the glue simplifies the manufacture of the roof bolt, because the drill tip can be glued to the leading end and the glue left to cure (possibly at an elevated temperature) without additional processing required.

BRIEF DESCRIPTION OF THE DRAWINGS

The attached drawings show an example embodiment of the invention of the foregoing kind. The particularity of those drawings and the associated description does not supersede the generality of the preceding broad description of the invention.

DESCRIPTION OF A PREFERRED EMBODIMENT

Figure 1:
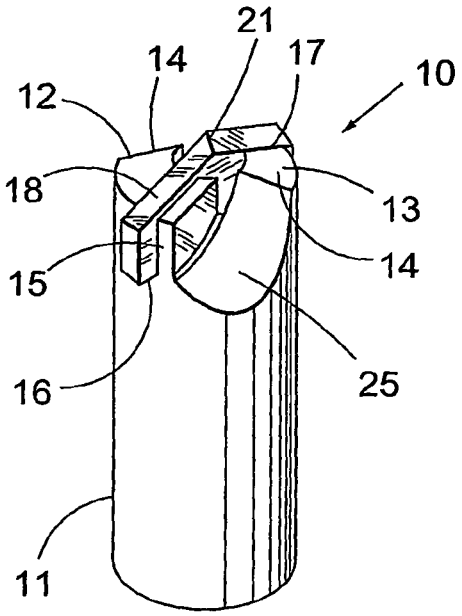
FIG. 1 shows the leading end of a roof bolt according to one embodiment of the present invention.

FIG. 1 shows the leading end of a self drilling roof bolt (10) according to one aspect of the present invention. Typically the bolt (10) would have a length of about 1800-2400 mm and would include an arrangement for driving it to rotate for drilling purposes. Such an arrangement is usually provided at the trailing end of the bolt and can comprise the end being formed square or hexagonal for gripping in a chuck, or can be formed as a nut. Drill rods generally are driven by engaging the end in a chuck, whereas roof bolts normally are driven by the nut, which is later used for tightening the bolt in place.

The bolt (10) is normally formed as a cylinder, having a circular outer surface and a central circular bore. The outer surface can be formed with ribs that enhance the secure location of the bolt in a wall and the ribs may be formed as a thread. Often the thread is formed to be discontinuous to create a lengthwise flat portion (unthreaded) preferably on each of opposite sides of the bolt. This facilitates transport of drilled rock debris to the rear end of the bolt for removal. That removal can be assisted by flushing medium which can be pumped to the leading end through the central bore for discharge therefrom. It is possible however to have a continuous thread which extends substantially the length of the bolt and in such a bolt, the thread may be deeper to facilitate clearance of debris.

As the novel characteristics of the bolt reside in the construction of the leading end thereof, no further discussion of other parts of the bolt (10) will be made.

The bolt (10) has a leading end (11) which defines a drill bit for drilling into rock. The drill bit includes a pair of abutment elements (12, 13) which extend axially from the leading end (11). The abutment elements (12, 13) are provided on diametrically opposite sides of the leading end (11). The abutment elements (12, 13) each have a trailing portion (14) and a leading portion (15), which define between them slots (16, 17). The slots (16, 17) accommodate a drill tip (18) which in the illustrated embodiment, extends diametrically across the leading end (11).

Figure 3:
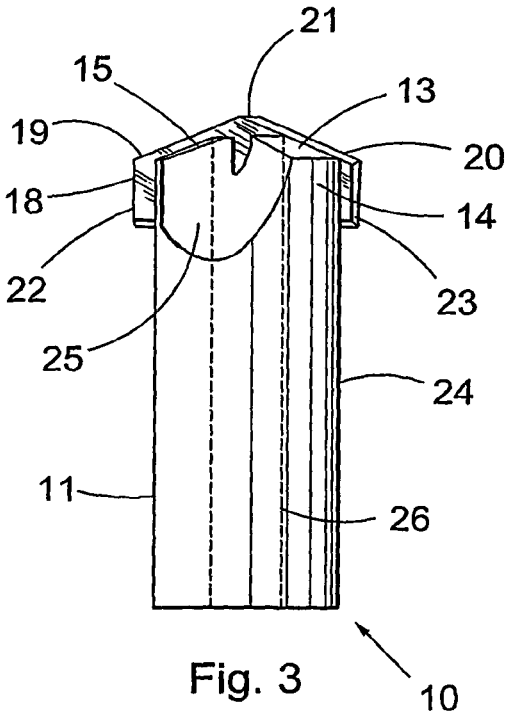
FIG. 3 is a radial view of the roof bolt of FIG. 1.
Figure 4:
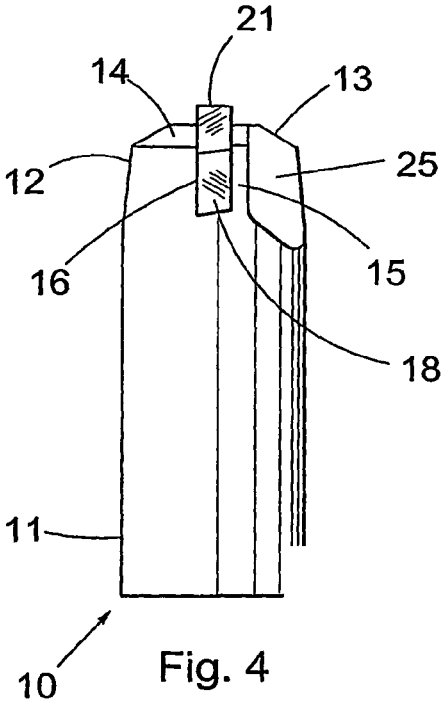
FIG. 4 is a further side view of the roof bolt of FIG. 1 rotated at about 90° from the FIG. 3 view.

The drill tip (18) has a pair of inclined cutting edges (19, 20) (see FIG. 3) which incline towards a central apex (21). The drill tip (18) defines a pair of axially extending radial edges (22, 23) which extend outside the outer cylindrical periphery (24) of the leading end (11). The edges (22, 23) are formed as cutting edges, so that the drill tip (18) drills a hole of greater diameter than the diameter of the leading end (11) and the remaining bolt body which depends from the leading end.

Between the trailing portion (14) of one of the abutment elements (12, 13) and the leading portion (15) of the other of those abutment elements, on each side of the drill bit (18), the leading end is inclined to form scalloped faces (25). By this arrangement, frontal clearance is provided for the drill bit (18) to facilitate drilling action thereof.

Figure 2:
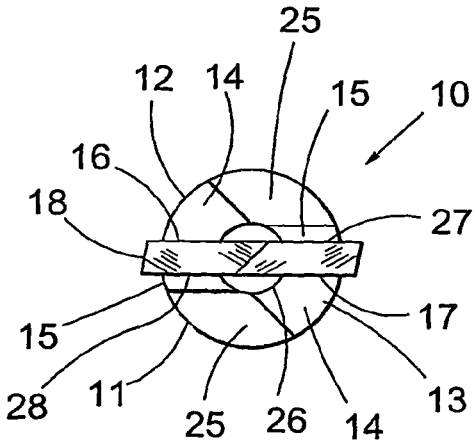
FIG. 2 is a plan view of the roof bolt of FIG. 1.

The bolt (10) includes a central bore (26) and it can be seen from FIG. 2 that the bore (26) is open at the leading end (11), on either side of the drill bit (18) which extends diametrically across the bore and the leading end. The bore (26) is used to transport flushing medium to the leading end (11) for flushing drilled material from the leading end (11) rearwardly and out of the drilled hole, and for introducing setting adhesive for fixing the bolt (10) within the drilled hole. The bore (26) can take a variety of different forms and can include branching conduits, which extend from the bore (26), to achieve different distribution of flushing medium or adhesive.

As shown in the figures, the drill tip (18) is accommodated by, or received within the slots (16, 17). The slots (16, 17) support the drill tip (18) along the base thereof and along the front and rear faces (27, 28) thereof. By that support, adhesive glue may be employed to fix the drill tip (18) to the leading ends. A suitable adhesive glue is Permabond ESP110. By forming the abutment elements (12, 13) so that the trailing portions (14) thereof, have a greater bulk or mass than the leading portions (15) thereof the trailing portions have a greater load bearing capacity than the leading portions, which is appropriate, because it is the trailing portions which facilitate the transmission of drive to the drill tip (18) and it is the trailing portions which accept the major portion of the load the drill tip experiences during drilling. The leading portions (15) are exposed to much less load and therefore it is appropriate that they have much less bulk than the trailing portions.

The leading portions in effect act only to facilitate the secure location of the drill tip (18) to the leading end (11) by increasing the bond area for adhesive bonding. Accordingly, the absence of the leading portions (15) would mean that the drill tip (18) would have to be secured to the leading end (11) by other arrangements, such as by welding, soldering or brazing. However, because the leading portions (15) increase the bond area, adhesive glues become appropriate for use providing the advantages set out earlier.

It will be appreciated that the self drilling roof bolt illustrated in the drawings has the drill bit arrangement of the invention integrally formed with the elongate bolt body of the bolt. However, it is equally permissible that the drill bit be formed separately from the bolt body and fixed thereto by any suitable attachment arrangement. For example, the drill bit may be formed for threaded connection to the bolt body. Moreover, in relation to drill rods, it is generally necessary for the drill bit to be replaceable, so that when the drill tip has worn, the drill bit can be removed and replaced. Self drilling roof bolts do not have this requirement, because the bolt only experiences a single drilling operation, at the completion of which the bolt is fixed within the drilled hole.

The construction of the drill bit of the present invention and of drill rods and self drilling roof bolts which employ the present invention, advantageously facilitates the preferred use of adhesive glue for securing a drill tip to a bolt, and consequently simplifies the manufacture of drill rods and self drilling roof bolts, and reduces their overall cost, as well as the cost of associated machinery used in their manufacture.

The invention described herein is susceptible to variations, modifications and/or additions other than those specifically described and it is to be understood that the invention includes all such variations, modifications and/or additions which fall within the spirit and scope of the above description.

The invention claimed is:

1. A drill bit defining a longitudinal center axis and including an axial trailing end configured for attachment to an end of an elongate drill rod, and an axial leading end including a pair of axially forwardly extending abutment elements, each abutment element having circumferential leading and trailing ends with reference to a direction of drilling rotation; each abutment element having an axially forwardly open slot formed therein for separating the respective abutment element into circumferential leading and trailing portions on which the circumferential leading and trailing ends are respectively disposed; each slot being situated closer to the circumferential leading end than to the circumferential trailing end, wherein the circumferential trailing portion is of greater width in the circumferential direction than is the circumferential leading portion; said slots being diametrically opposed and receiving respective drill tip portions which project axially forwardly from the respective slots; each circumferential trailing portion extending axially forwardly farther than the associated circumferential leading portion; each drill tip portion being secured by adhesive to the respective circumferential leading and trailing portions, wherein a substantial portion of a surface of the drill tip portion adjacent to the respective circumferential leading portion is in contact said respective circumferential leading portion.

2. The drill bit according to claim 1 wherein an axial front end of each circumferential leading portion is disposed closer to an axial front end of the respective drill tip portion than to an axial rear end thereof.

3. The drill bit according to claim 1 further including a central through-bore extending along the axis and intersecting the axial front end between the slots.

4. The drill bit according to claim 1 wherein each slot has a generally rectangular cross section.

5. The drill bit according to claim 1 wherein each drill tip portion has an axial dimension varying along a radial extent of the slot, the slot having a correspondingly varying axial dimension wherein each drill tip portion extends from its respective slot by a constant distance along the radial extent thereof.

6. The drill bit according to claim 1 wherein each slot receives its respective drill tip portion with a snug fit.

7. The drill bit according to claim 1 wherein both drill tip portions are defined by a one-piece drill tip.

8. The drill bit according to claim 1 wherein the drill tip portions constitute separate pieces.

9. The drill bit according to claim 1 wherein the adhesive comprises glue.

10. A drill rod for drilling in rock, comprising an elongate body and a drill bit, the elongate body having a first central bore extending therethrough, the drill bit defining a longitudinal center axis and including an axial trailing end attached to an end of the drill rod, and an axial leading end including a pair of axially forwardly extending abutment elements, each abutment element having circumferential leading and trailing ends with reference to a direction of drilling rotation; each abutment element having an axially forwardly open slot formed therein for separating the respective abutment element into circumferential leading and trailing portions; each slot being situated closer to the circumferential leading end than to the circumferential trailing end, wherein the circumferential trailing portion is of greater width in the circumferential direction than is the circumferential leading portion; said slots being diametrically opposed and receiving respective drill tip portions which project axially forwardly from the respective slots; each circumferential trailing portion extending axially forwardly farther than the associated circumferential leading portion; each drill tip portion being secured by adhesive to the respective circumferential leading and trailing portions; a second central bore extending through the drill bit and communicating with the first central bore and the axial leading end, wherein a substantial portion of a surface of the drill tip portion adjacent to the respective circumferential leading portion is in contact said respective circumferential leading portion.

11. The drill rod according to claim 10 wherein the drill bit is detachably attached to the end of the drill rod.

12. The drill bit according to claim 10 wherein an axial front end of each circumferential leading portion is disposed closer to an axial front end of the respective drill tip portion than to an axial rear end thereof.

13. A self-drilling roof bolt for drilling and bolting into rock, comprising an elongate body and a drill bit, the elongate body including a first central bore extending therethrough, the drill bit defining a longitudinal center axis and including an axial trailing end attached to an end of the elongate body, and an axial leading end including a pair of axially forwardly extending abutment elements, each abutment element having circumferential leading and trailing ends with reference to a direction of drilling rotation; each abutment element having an axially forwardly open slot formed therein for separating the respective abutment element into circumferential leading and trailing portions; each slot being situated closer to the circumferential leading end than to the circumferential trailing end, wherein the circumferential trailing portion is of greater width in the circumferential direction than is the circumferential leading portion; said slots being diametrically opposed and receiving respective drill tip portions which project axially forwardly from the respective slots; each circumferential trailing portion extending axially forwardly farther than the associated circumferential leading portion; each drill tip portion being secured by adhesive to the respective circumferential leading and trailing portions; a second central bore extending through the drill bit and communicating with the first central bore and the axial leading end, wherein a substantial portion of a surface of the drill tip portion adjacent to the respective circumferential leading portion is in contact said respective circumferential leading portion.

14. The roof bolt according to claim 13 wherein the drill bit is removably attached to the elongate body.

15. The roof bolt according to claim 13 wherein an axial front end of each circumferential leading portion is disposed closer to an axial front end of the respective drill tip portion than to an axial rear end thereof.

* * * * *